US007669987B2

(12) United States Patent
Kusunoki et al.

(10) Patent No.: US 7,669,987 B2
(45) **Date of Patent: *Mar. 2, 2010**

(54) INK JET RECORDING APPARATUS

(75) Inventors: Ryutaro Kusunoki, Shizuoka-ken (JP); Tomoka Takanose, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 537 days.

This patent is subject to a terminal disclaimer.

(21) Appl. No.: 11/353,980

(22) Filed: Feb. 15, 2006

(65) Prior Publication Data

US 2006/0187273 A1 Aug. 24, 2006

(30) Foreign Application Priority Data

Feb. 16, 2005 (JP) ..... P2005-039397

(51) Int. Cl.
*B41J 2/045* (2006.01)
*B41J 29/38* (2006.01)

(52) U.S. Cl. ..... 347/69; 347/10

(58) Field of Classification Search ..... 347/9–11, 347/68, 69

See application file for complete search history.

(56) References Cited

U.S. PATENT DOCUMENTS 5,764,247 A * 6/1998 Asai ..... 347/10
7,367,658 B2 * 5/2008 Kusunoki et al. ..... 347/68
2004/0181383 A1 * 9/2004 Yu et al. ..... 703/9
2005/0099452 A1 5/2005 Kusunoki

FOREIGN PATENT DOCUMENTS

JP 2000-255055 9/2000
JP 2000-255055 A 9/2000
JP 2002-86712 A 3/2002

OTHER PUBLICATIONS

Notice of Rejection dated Jul. 31, 2007.

* cited by examiner

*Primary Examiner*—Stephen D Meier
*Assistant Examiner*—Geoffrey Mruk
(74) *Attorney, Agent, or Firm*—Pillsbury Winthrop Shaw Pittman LLP

(57) ABSTRACT

An ink jet recording apparatus includes an ink jet recording head having actuators that are caused to deflect so as to vary a volume of a pressure chamber according to a drive signal applied between an electrode associated with a pressure chamber from which ink is ejected and ones associated with two pressure chambers sandwiching the former, and a drive signal generator that generates a drive signal for driving the pressure chambers in the five time-divisional drive method. The drive signal generator simultaneously supplies drive signals for alleviating deflection of an actuator or actuators at the outmost position among six actuators disposed close around a pressure chamber from which ink is to be ejected to electrodes associated with the five pressure chambers close around one from which ink is not to be ejected at a timing when the ink ejection therefrom is enabled. Thus, variations in velocity and volume between ink droplets ejected that are caused due to cross-talk between chambers can be reduced.

6 Claims, 18 Drawing Sheets

INK JET RECORDING APPARATUS

CROSS REFERENCE OF THE INVENTION

This application is based upon and claims the benefit of priority from the prior Japanese Patent Application No. 2005-039397 filed on Feb. 16, 2005, the contents of which are incorporated herein by reference.

BACKGROUND OF THE INVENTION

1) Field of the Invention

The present invention relates to an ink jet recording apparatus that ejects ink and records an image on a recording medium, particularly to an ink jet recording apparatus that ejects ink droplets from a nozzle communicating with a pressure chamber by driving actuators of side walls partitioning the respective pressure chambers to cause the actuators to deflect so as to vary a volume of the pressure chamber.

2) Description of Related Art

A so-called "shared-wall type recording head," i.e. a recording head having side walls constituted by actuators of such as piezoelectric members that isolate the respective pressure chambers, includes a problem of cross-talk that occurs by deflection of an actuator through propagation of a pressure change via a neighboring chamber produced within one pressure chamber and adversely changes velocities and volumes of ink droplets that are ejected to form an image. A Japanese patent application publication number 2000-255055 describes a method of driving an ink jet recording head of compensating the adverse deviation of velocity of an ink droplet that is ejected by cross-talk by creating a pressure fluctuation within a pressure chamber that is operated not to eject ink.

However, this method of ink jet recording could not sufficiently reduce the variations in ink ejection velocity and volume due to the cross-talk between pressure chambers, although the method improves them at a certain degree, because the pressure fluctuation creating a counter cross-talk that compensates the variation of the ink ejection velocity is limited to such a degree that an ink cannot be ejected.

SUMMARY OF THE INVENTION

In view of the above problem, the present invention provides an ink jet recording apparatus that can reduce variations in velocity and volume of an ink that appear depending on different recording patterns by sufficiently reducing variations in velocity and volume of an ink droplet due to cross-talk between pressure chambers, and thus improve quality of ink jet recording.

In one preferable embodiment, the invention provides an ink jet recording apparatus that comprises an ink jet recording head having a plurality of nozzles ejecting ink, a plurality of pressure chambers communicating with the respective nozzles, ink supplying means for supplying ink to the respective pressure chambers, a plurality of electrodes provided relative to the respective pressure chambers that cause ink to be ejected, and actuators that form side walls isolating the respective pressure chambers and are caused to deflect according to drive signals, which are applied between one electrode relative to a pressure chamber from which ink is ejected and the two electrodes relative to the two pressure chambers adjacent to the former, causing a volume of the pressure chamber ejecting ink to vary, and a drive signal generator that supplies a deflection-preventing signal for preventing deflection of the outmost actuator or actuators among (N+1) actuators disposed close around the pressure chamber that causes ink to be ejected to at least one of two electrodes sandwiching an outmost actuator (or actuators), wherein the ink jet recording head is operated so as to eject ink droplets from every N pressure chambers (where $N=2M+1$, $M \geqq 1$).

DESCRIPTION OF THE PREFERRED ENBODIMENTS

Figure 1:
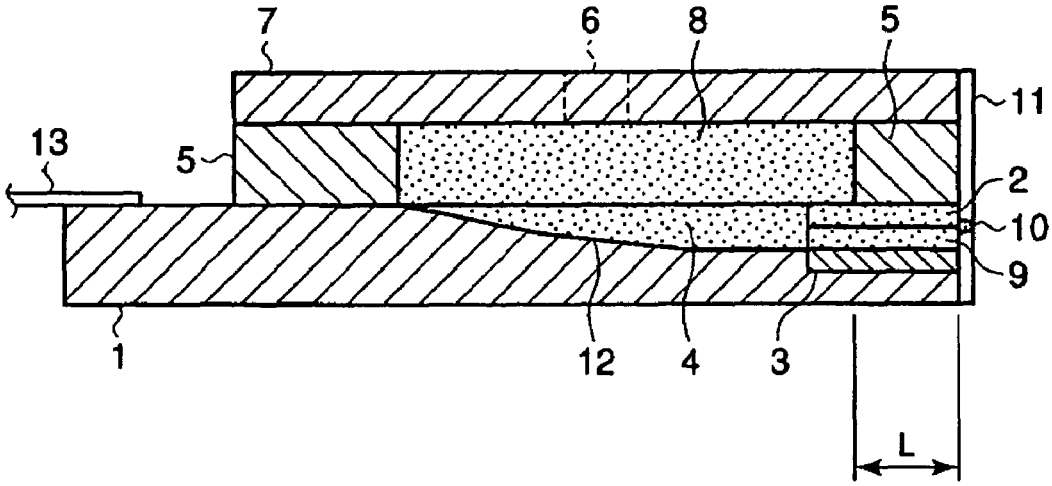
FIG. 1 is a longitudinal cross sectional view showing a whole structure of an ink jet recording head according to one embodiment of the present invention.

One embodiment according to the present invention will be described in reference to the accompanying drawings, in which like reference numerals denote like structures.

A structure of an ink jet recording head used in this embodiment is now described. FIG. 1 is a longitudinal cross sectional view illustrating a whole structure of an ink jet recording head. As shown in the FIGURE, in the fore-end of a substrate 1 of a low dielectric constant there are embedded two piezoelectric members being glued together such that the respective polarization directions of two piezoelectric members 2, 3, each of which are polarized in the plate thickness direction, are opposed to each other. In the piezoelectric members 2, 3 and a portion of substrate 1 in the back of the piezoelectric members 2, 3, a plurality of grooves are formed in parallel with the grooves spaced from each other at a prescribed distance in a specified depth, width, and length in a process of cutting using a disc diamond cutter. Piezoelectric members 2, 3 partitioning the grooves and substrate 1 constitute "side walls."

An ink supply path 8 from which ink is supplied into the grooves is formed such that a top plate frame 5 and top plate lid 7 having ink supply port 6 are adhered onto substrate 1. A nozzle plate 11 in which nozzles 10 for ejecting an ink droplet are formed is fixed by gluing to the forefronts formed by top plate lid 7, top plate frame 5, piezoelectric members 2, 3, and substrate 1. An electrode 12 that drives piezoelectric members 2, 3 is formed electrically independently from each other within the interior wall of the groove and extends to an upper surface of substrate 1. The respective electrodes are connected to a drive circuit (later described) that is provided on a circuit board 13.

The piezoelectric member forming the side wall serves as an actuator, which deflects by applying a voltage between two electrodes sandwiching it. A room defined by top plate frame 5 and a portion of the groove interior walls at a length L forms a pressure chamber for ejecting ink.

The electrodes are respectively formed such that, first, a portion of the groove excluding a required pattern is masked by a resist, the whole part is electroless-plated, and the mask is peeled off the grooves 4 surface. Alternatively, after producing a film with an electrode material by a spattering or vacuum deposition process, a desired patter of electrode may be formed by etching.

Figure 2:
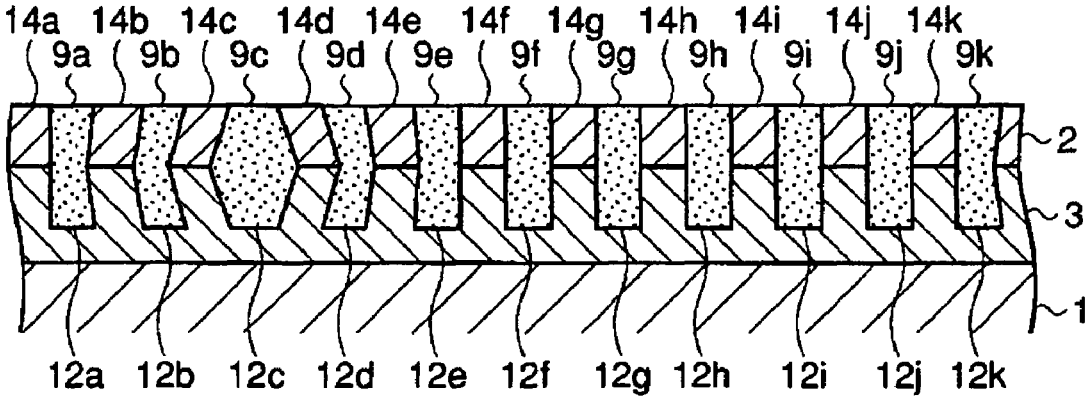
FIG. 2 is a transverse cross sectional view showing an apical portion of the ink jet recording head according to the same embodiment.

FIG. 2 is a transverse sectional view illustrating a structure of the fore end of the ink jet recording head. Operation of the ink jet recording head will now be described in reference to this FIGURE. In the FIGURE, reference numerals 9*a*-9*k* denote pressure chambers; 12*a*-12*k* denote electrodes formed within pressure chambers 9*a*-9*k*; 14*a*-14*k* denote actuators consisting of respective piezoelectric members 2 and 3 that are formed as side walls between the respective pressure chambers.

Now, how an ink droplet is ejected from pressure chamber 9*c* will be described as in the case that the ink jet recording head is operated in the time-division driving method. Herein, nozzles 10*a*-10*j* associate with pressure chambers 9*a*-9*j*, respectively.

Ink supplied into the ink jet recording head from ink supply port 6 is filled in pressure chamber 9 through ink supply path 8. When a potential difference is presented between the electrodes 12*c* and 12*b*, and concurrently 12*c* and 12*d*, actuators 14*c* and 14*d* are deflected in the shear mode thereby varying a volume of pressure chamber 9*c* so that an ink droplet is ejected from nozzle 10*c*.

This ink jet recording head is a so-called shared wall type recoding head, in which one actuator 14 is shared by two pressure chambers 9 that neighbor to it on the both sides. Because one actuator is shared by two pressure chambers, mutually neighboring two pressure chambers 9 cannot be concurrently operated. For this reason, in this recording head the time divisional driving method is employed, in which pressure chambers of every odd number of three or more are driven so as to eject inks concurrently while preventing mutually neighboring two pressure chambers from operating at a time. In other words, printing is controlled such that signals that drive every even number N pressure chambers from which inks are made to be ejected at a time are applied to the electrodes provided within the respective pressure chambers, where N=2M+1 (M equals or greater than one). In this embodiment, operation is described in five-time-divisional drive method by way of example.

Furthermore, for example, in the case where ink is made to be ejected from pressure chamber 9*c*, voltages are imparted also between electrodes 12*a* and 12*b*, and between 12*d* and 12*e*, whereby actuators 14*b* and 14*e* are driven to deflect so that pressure vibrations of ink produced within pressure chambers 9*b* and 9*d* can be deconcentrated towards pressure chambers 9*a* and 9*e*.

In this manner, by deconcentrating pressure vibration of ink produced within a pressure chamber that is not intended to cause ink ejection towards others, amplitude of a meniscus vibration at the non-ink-ejecting nozzle can be reduced. As a result, meniscus protruding from a surface of a non-ink-ejecting nozzle caused by the subsequent vibration can be suppressed. This effects reduction in terms of variation of meniscus positions and ejection velocities of ink droplets, thus improving recording quality.

Next, the drive signal generator that generates a signal to drive the ink jet recoding head will be described.

Figure 3:
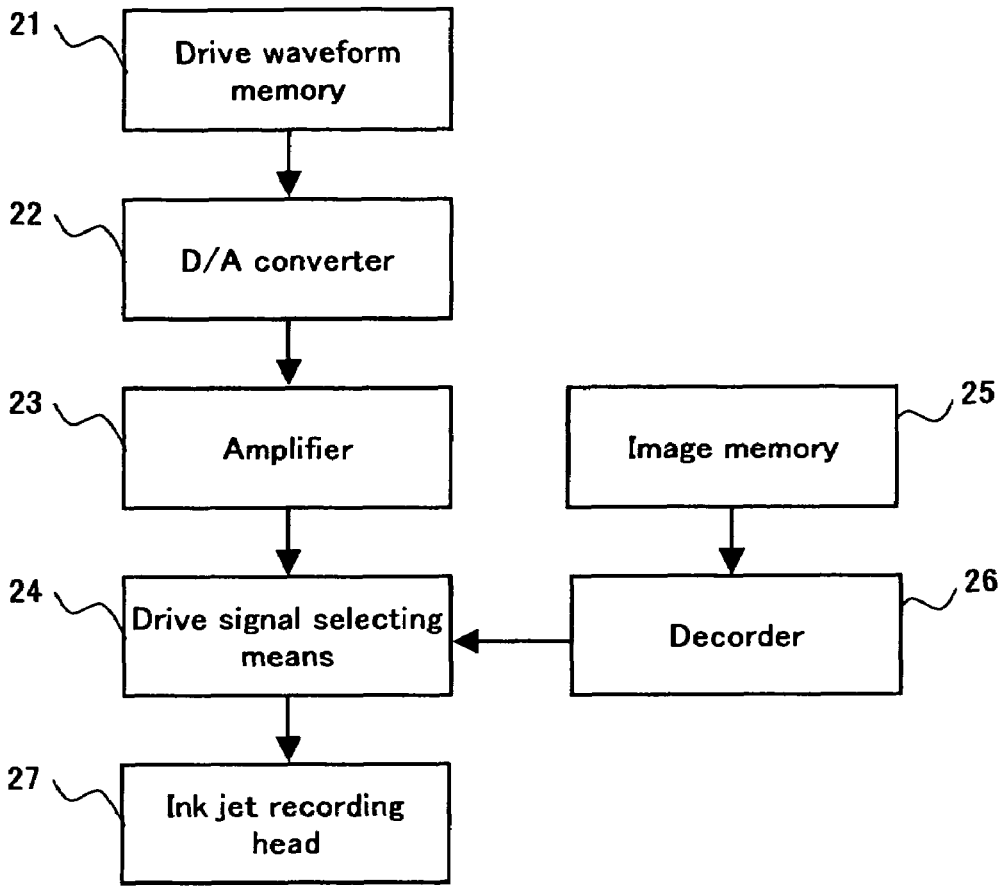
FIG. 3 is a block diagram of a drive circuit in the ink jet recording head according to the same embodiment.

As shown in FIG. 3, the drive signal generator is constituted by a drive waveform memory 21, D/A converter 22, amplifier 23, drive signal selecting means 24, image memory 25, and decoder 26. Drive waveform memory 21 memorizes information on waveforms of drive signals ACT1-ACT 5 that are applied to pressure chambers 9 causing ink to be ejected, and information on waveforms of drive signals INA that are applied to pressure chambers 9 not causing ink to be ejected. D/A converter 22 receives information on waveforms of drive signals ACT1-ACT 5 and INA, and converts the waveform information into analog signals. Amplifier 23 amplifies these drive signals ACT1-ACT 5 and INA now converted into analog signals, and outputs them to drive signal selecting means 24. The drive signals are selected through decoder 26 based on information on gradation of each pixel in an image memorized in image memory 25. Decoder 26 generates ON/OFF signals that determines ejection or non-ejection of an ink droplet according to the gradation information of each pixel in an image memorized an image memory 25, and output the ON/OFF signals to drive signal selecting means 24. Drive signal selecting means 24 selects a drive signal from drive signals ACT1-ACT 5 and INA according to the ON/OFF signals, and applies it to the ink jet recording head.

In this embodiment, recoding is carried out at gradation of eight levels at maximum per a pixel. That is, this eight level gradation recording is carried out by controlling ejection or non-ejection of three types of ink droplets consisting of a first drop of 6 pico-liter in a volume of an ejected ink droplet, second drop of 12 pico-liter of an ejected ink droplet, and third drop of 24 pico-liter of an ejected ink droplet in the manner shown in Table 1.

TABLE 1

| Gradation Level | First droplet (a volome of 6 pico liters) | Second droplet (a volome of 12 pico liters) | Third droplet (a volome of 24 pico liters) | Total volume of accumulated droplets |
|---|---|---|---|---|
| 0 | OFF | OFF | OFF | 0 pl |
| 1 | ON | OFF | OFF | 6 pl |
| 2 | OFF | ON | OFF | 12 pl |

TABLE 1-continued

| Gradation Level | First droplet (a volome of 6 pico liters) | Second droplet (a volome of 12 pico liters) | Third droplet (a volome of 24 pico liters) | Total volume of accumulated droplets |
|---|---|---|---|---|
| 3 | ON | ON | OFF | 18 pl |
| 4 | OFF | OFF | ON | 24 pl |
| 5 | ON | OFF | ON | 30 pl |
| 6 | OFF | ON | ON | 36 pl |
| 7 | ON | ON | ON | 42 pl |

Figure 4:
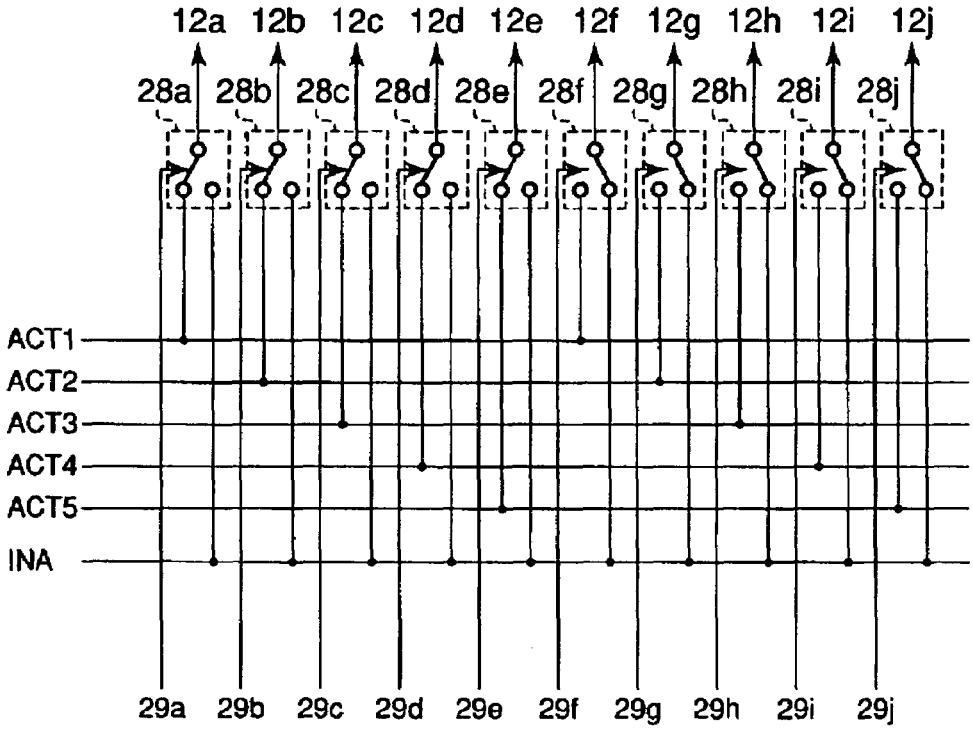
FIG. 4 shows a circuit diagram of the drive signal selecting means indicated in FIG. 3.

Now, drive signal selecting means 24 will be described. As shown in FIG. 4, drive signal selecting means 24 includes analog switches 28*a*-28*j*, which are operated for On/Off switching according to ON/OFF signals 29*a*-29*j* from decoder 26. Although FIG. 4 shows analog switches corresponding to some of electrodes shown in FIG. 2, these switches are actually provided corresponding to electrodes 12 of all the pressure chambers 9 in the recording head.

When ON/OFF signals 29*a*-29*e* are "on," analog switches 28*a*-28*e* select drive signals ACT1-ACT5 that are input from amplifier 23 and lead the signals to electrodes 12*a*-12*e* of ink jet recording head 27, respectively. When ON/OFF signals 29*a*-29*e* are "off," analog switches 28*a*-28*e* select drive signals INA also input from amplifier 23 and lead the signals to electrodes 12*a*-12*e* of ink jet recording head 27, respectively.

When ON/OFF signals 29*f*-29*j* are "on," analog switches 28*f*-28*j* select drive signals ACT1-ACT5 that are input from amplifier 23 and lead the signals to electrodes 12*f*-12*j* of ink jet recording head 27, respectively. When ON/OFF signals 29*f*-29*j* are "off," analog switches 28*f*-28*j* select drive signals INA also input from amplifier 23 and lead the signals to electrodes 12*f*-12*j* of ink jet recording head 27, respectively.

Drive signals ACT1-ACT5 correspond to the first through fifth cycle in five time-divisional driving operation. For example, at a certain timing if an ink droplet is desired to be ejected from pressure chamber 9*c* but not from pressure chamber 9*h* which is apart from 9*c* by five positions at the same operation timing, ON/OFF signal 29*c* relative to pressure chamber 9*c* and ON/OFF signals 29*a*, 29*b*, 29*d*, and 29*e*, which relate to two respective positions on the both side of pressure chamber 9*c*, are turned on, while ON/OFF signal 29*h* relative to pressure chamber 9*h* and ON/OFF signals 29*f*, 29*g*, 29*i*, and 29*j*, which relate to two positions on the both side of pressure chamber 9*h*, are turned off. According to these ON/OFF signals 29*a*-29*j*, drive signal ACT3 is given to pressure chamber 9*c* from which an ink droplet is to be ejected and drive signals ACT1, ACT2, ACT4, and ACT5 are given to pressure chambers 9*a*, 9*b*, 9*d*, and 9*e*, i.e. two positions on the both sides of pressure chamber 9*c*, while drive signal INA is given to pressure chamber 9*h* not ejecting an ink droplet and 9*f*, 9*g*, 9*i*, and 9*j*, which are two each on the both side of pressure chamber 9*h*.

Drive signals ACT1-ACT5 for ejecting ink and drive signal INA for not ejecting ink supplied to drive signal selecting means 24 are now described.

Figure 5:
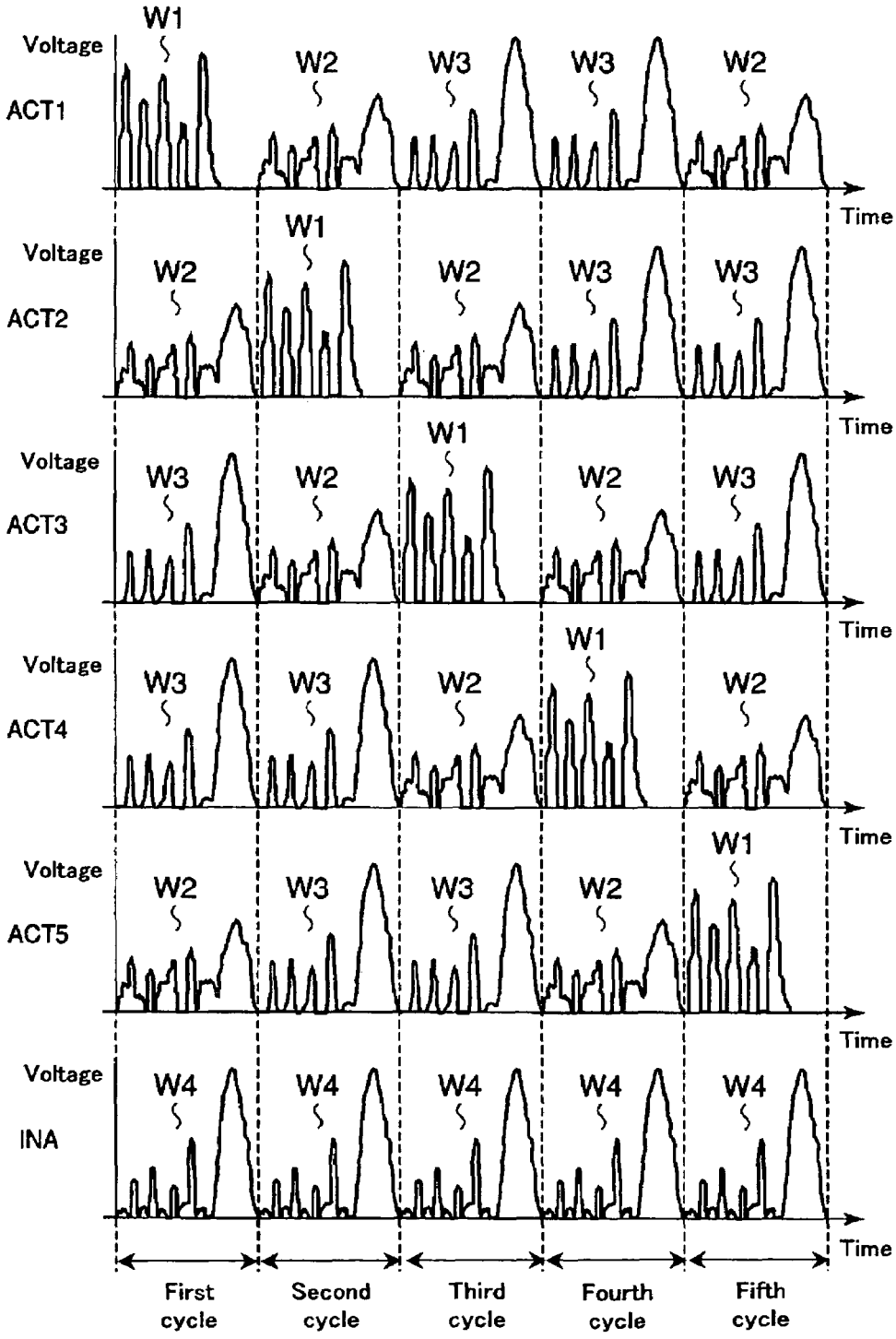
FIG. 5 shows waveforms of drive signals inputted to the drive signal selecting means indicated in FIG. 3.

In FIG. 5, drive signals ACT1-ACT5 and INA in one printing period each consisting of five cycles are displayed. The respective drive signals ACT1-ACT5 include three different types of drive signals W1, W2, and W3, while drive signal INA is constituted by drive signal W4 only. Drive signal W1 is one that is applied to electrode 12 relative to pressure chamber 9 from which an ink droplet is to be ejected.

The respective drive signals ACT1-ACT5 differ in "phase" from one to another by a division cycle. For example, when pressure chamber 9*c* in FIG. 2 is desired to eject an ink droplet, pressure chamber 9*c* is operated in the third cycle. In this third cycle, first, ON/OFF signals 29*a*-29*e* are turned on, then drive signal W3 is applied to electrodes 12*a* and 12*e* relative to pressure chambers 9*a* and 9*e*, respectively; drive signal W2 is applied to electrodes 12*b* and 12*d* relative to pressure chambers 9*b* and 9*d*, respectively; and drive signal W1 is applied to electrode 12*c* relative to pressure chambers 9*c*.

Figure 6:
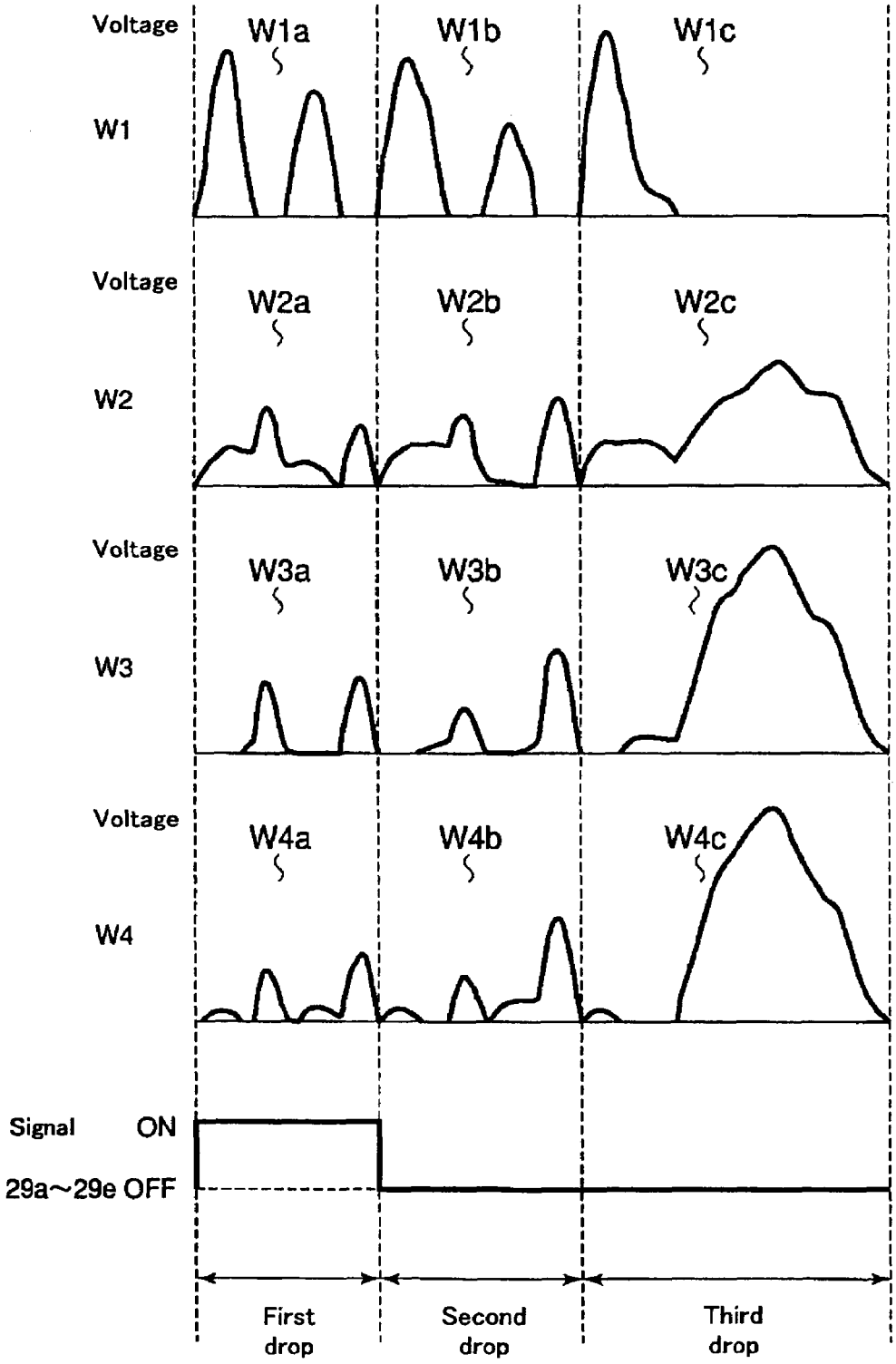
FIG. 6 shows component voltage waveforms constituting the drive signal waveforms depicted in FIG. 5.

Next, drive signals W1 through W4 will be described. As shown in FIG. 6, drive signal W1, W2, W3, and W4 are constituted by drive signals W1*a*, W2*a*, W3*a*, and W4*a*, respectively, all of which are disposed at the stage where ejection of the first droplet having a volume of 6 pico-liters takes place; by W1*b*, W2*b*, W3*b*, and W4*b*, respectively, all residing at the stage where ejection of the second droplet having a volume of 12 pico-liters takes place; and by W1*c*, W2*c*, W3*c*, and W4*c*, respectively, all residing at the stage where ejection of the third droplet having a volume of 24 pico-liters takes place.

In another example, if the first droplet is desired to be ejected from pressure chamber 9*c* but the same droplet not from pressure chamber 9*h*, ON/OFF signals 29*a*-29*e* are turned on at the first-drop stage within the third cycle shown in FIG. 5, while ON/OFF signals 29*f*-29*j* are turned off. As a result, drive signal W1*a* is applied to electrode 12*c*, W2*a* is applied to electrodes 12*b* and 12*d*, W3*a* is applied to electrode 12*a* and 12*e*, and W4*a* is applied to electrodes 12*f*-12*j*.

According to combination of these drive signals W1*a*-W4*a*, actuators 14*b*-14*f* operates in the following manner. Actuators 14*c* and 14*d* are largely deflected according to the potential difference between W1*a* and W2*a*, and thereby an ink droplet of 6 pico liters is ejected from pressure chamber 9*c*. Actuators 14*b* and 14*e* are deflected according to the potential difference between drive signals W2*a* and W3*a* so as to deconcentrate pressure vibrations developed within pressure chambers 9*b* and 9*d* towards pressure chambers 9*a* and 9*e*. According to the potential difference between drive signals W3*a* and W4*a*, actuator 14*f* is given a force that opposes a force that tends to make the same actuator 14*f* deflect being exerted by the pressure produced in pressure chamber 9*e*. As a result, the actuator 14*f* substantially remains still.

In other words, a deflection preventing signal is provided that substantially intercepts the outmost actuators 14*a* and 14*f* deflecting by the ink pressure (derived from the pressure vibration produced within the ink-ejecting pressure chamber) at the timing when an ink droplet is caused to be ejected from pressure chamber 9*c*, actuators 14*a* and 14*f* being the outmost among the respective three actuators of 14*a*, 14*b*, 14*c*, and 14*d*, 14*e*, 14*f* that reside on the both sides of pressure chamber 9*c*. This deflection preventing signal intercepts the outmost actuators deflecting among actuators of (N+1)/2 on the both sides of the pressure chamber that causes ink to be ejected at a time-divisional timing when the ink-ejection is enabled.

This substantial interception of deflection of actuator 14*f* can prevent the phenomenon in which the pressure vibration developed within pressure chamber 9*e* associating with operation of ink-ejection within pressure chamber 9*c* is transmitted to pressure chamber 9*f* via actuator 14*f*, and can substantially reduce the cross-talk via actuators down to an almost negligible degree. Since drive signal W4*a* is applied commonly to electrodes 12*f*, 12*g*, 12*h*, 12*i*, and 12*j*, an electric field is not generated in actuators 14*g*-14*j* that are sandwiched by the abovementioned electrodes. Accordingly, these actuators would not deflect and hence pressure vibration of ink would not been produced within pressure chambers 9*f*-9*j*. Because cross-talk via actuators have thus been reduced to an almost negligible level, variations in velocity and volume among ink droplets that are ejected can be sufficiently reduced.

Now, let us consider the case that the first droplet is made to be ejected concurrently from the pressure chambers 9*c* and 9*h*. In this case, ON/OFF signals 29*a*-29*j* are turned on at the first drop stage within the third cycle shown in FIG. 5. As a result, drive signal W1*a* is applied to electrodes 12*c* and 12*h*; drive signal W2*a* is applied to electrodes 12*b*, 12*d*, 12*g*, and 12*i*; and drive signal W3*a* is applied to electrodes 12*a*, 12*e*, 12*f*, 12*j*.

By this combinational operation of drive signals W1*a*-W3*a*, ink droplets having a volume of 6 pico liters are ejected from pressure chambers 9*c* and 9*h*. Since in this instance when ink droplets are concurrently ejected from pressure chambers 9*c* and 9*h*, the same drive signal W3*a* is applied to electrodes 12*e* and 12*f* that sandwich actuator 14*f*, electric field is not generated within the actuator 14*f*. Also, since the same quantity of pressure is created within pressure chambers 9*e* and 9*f* that sandwich actuator 14*f*, actuator 14*f* does not substantially deflect even when ink droplets are concurrently ejected from pressure chambers 9*c* and 9*h*.

Since the phenomenon, in which the pressure vibration developed within pressure chamber 9*e* associating with operation of ink-ejection within pressure chamber 9*c* is transmitted to pressure chamber 9*f* via actuator 14*f*, is blocked, cross-talk via actuators can be substantially reduced down to an almost negligible degree. That is, even when an ink droplet is to be ejected from one of pressure chambers 9*c* and 9*h* but not from the other, or when ink ejection is made from the both pressure chambers concurrently, variations among velocities and volumes of ink droplets that are ejected can be sufficiently reduced.

In the case that the first droplet is desired not to be ejected from both of pressure chambers 9*c* and 9*h*, ON/OFF signals 29*a*-29*j* are turned off at the first-drop stage within the third cycle shown in FIG. 5. At the same first-drop stage, drive signal W4*a* is applied to electrodes 12*a*-12*j* that sandwich the respective actuators, and thus electric field is not produced within the actuators. As a result, actuators 14*b*-14*j* are not deflected and hence a pressure vibration is not created within the respective pressure chambers 9*a*-9*j*.

In this way, because cross-talk associated with driving of pressure chamber 9*c* is blocked off at actuator 14*f* no matter whether ink ejection from pressure chamber 9*h* is carried out, velocities and volumes of ejected ink droplets become constant regardless of ink ejection from pressure chamber 9*h*. That is, recording quality can be improved by reducing variations in velocity and volume of ink droplets depending on different recording image patterns.

Now, how to determine drive signals W1 through W4 will be explained.

Hereinafter, term "vibrating flow velocity" is defined as a time-sequential change in a flow velocity of ink.

Drive signals W1-W4 can be obtained by inverse operation of drive signals from responsive characteristics of vibrating flow velocity in response to a drive signal in an ink jet recording head and a hypothetical meniscus vibration neglecting pull-back of a meniscus associated with ink ejection.

Hypothetical meniscus vibration is a meniscus vibration that is linear relative to a drive signal. It is a hypothetical vibration that excludes non-linear components relating to meniscus advancing associated with ink ejection from a nozzle, pull-back of a meniscus occurring immediately after an ink droplet has been ejected from a nozzle, and meniscus advancing associated with an ink refill action by surface tension and other factors, from a meniscus vibration actually produced during operation of ink ejection in an ink jet recording head.

Figure 7:
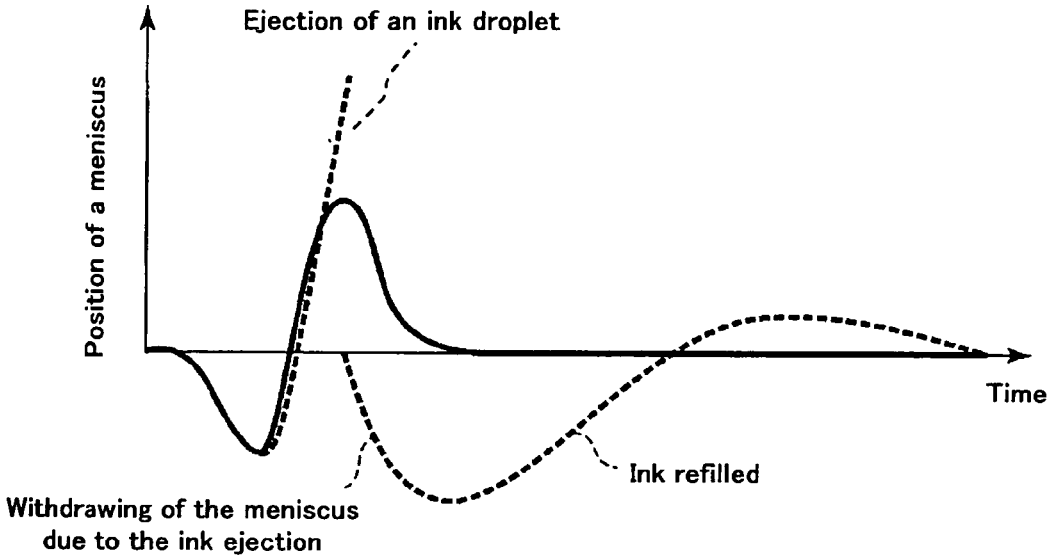
FIG. 7 illustrates a difference between a hypothetical meniscus vibration and an actual meniscus vibration.

The hypothetical meniscus vibration, which is a linear component of a meniscus vibration, can be considered to be an enlarged amplitude of a meniscus vibration produced when a drive signal having an amplitude reduced to a degree insufficient to eject ink is imparted to an ink jet recording head. FIG. 7 illustrates a difference between an actual meniscus vibration and a hypothetical meniscus vibration, wherein a hypothetical meniscus vibration is depicted in a solid line and an actual meniscus vibration in a dashed line.

As shown in FIG. 7, the hypothetical meniscus vibration reflects crucial characteristics relating to behaviors of ink during ink ejection in an inkjet recording head, such as cross talk occurring between the pressure chambers, though it differs from a meniscus vibration produced on actual ink ejection from a nozzle in an ink jet recording head. Meanwhile, since actual meniscus vibration is affected by the aforementioned non-linear component of the vibration, that is, factors irrelevant to the meniscus vibration caused by a drive signal, controlling an actual meniscus vibration by a drive signal is limited. On the contrary, because the hypothetical meniscus vibration is not affected by factors irrelevant to the meniscus vibration derive from a drive signal, it is very possible to effectively control a meniscus vibration by a drive signal. Thus, by defining a desired hypothetical meniscus vibration and applying a drive signal to actuators that produces the corresponding vibration, a desirable characteristic in view of preventing cross-talk between pressure chambers and other related phenomena can be obtained.

Next, the process of carrying inverse calculation for a drive signal from a hypothetical meniscus vibration will be described. First, a response characteristic R of vibrating flow velocities in response to a drive signal of the ink jet recording head, which is necessitated for the process of inverse calculation for a drive signal from a hypothetical meniscus vibration, is obtained. Then, a drive signal is calculated from the hypothetical meniscus vibration based on the response characteristic obtained.

Figure 8:
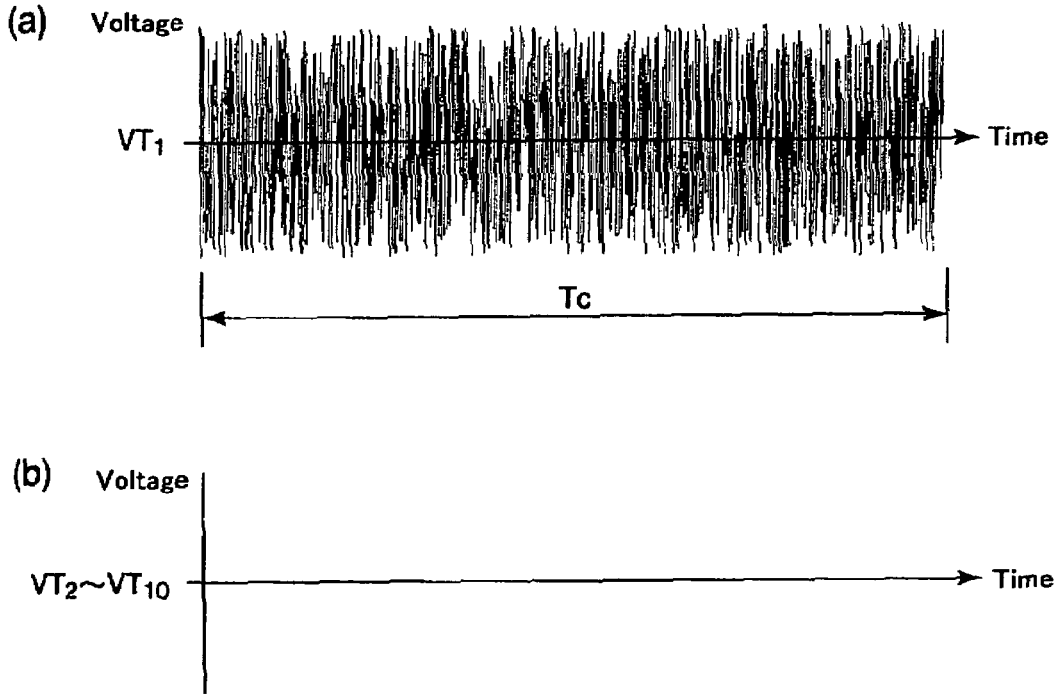
FIG. 8 shows a waveform of a drive signal used for measuring a frequency response characteristic of the recording head according to the same embodiment.
Figure 9:
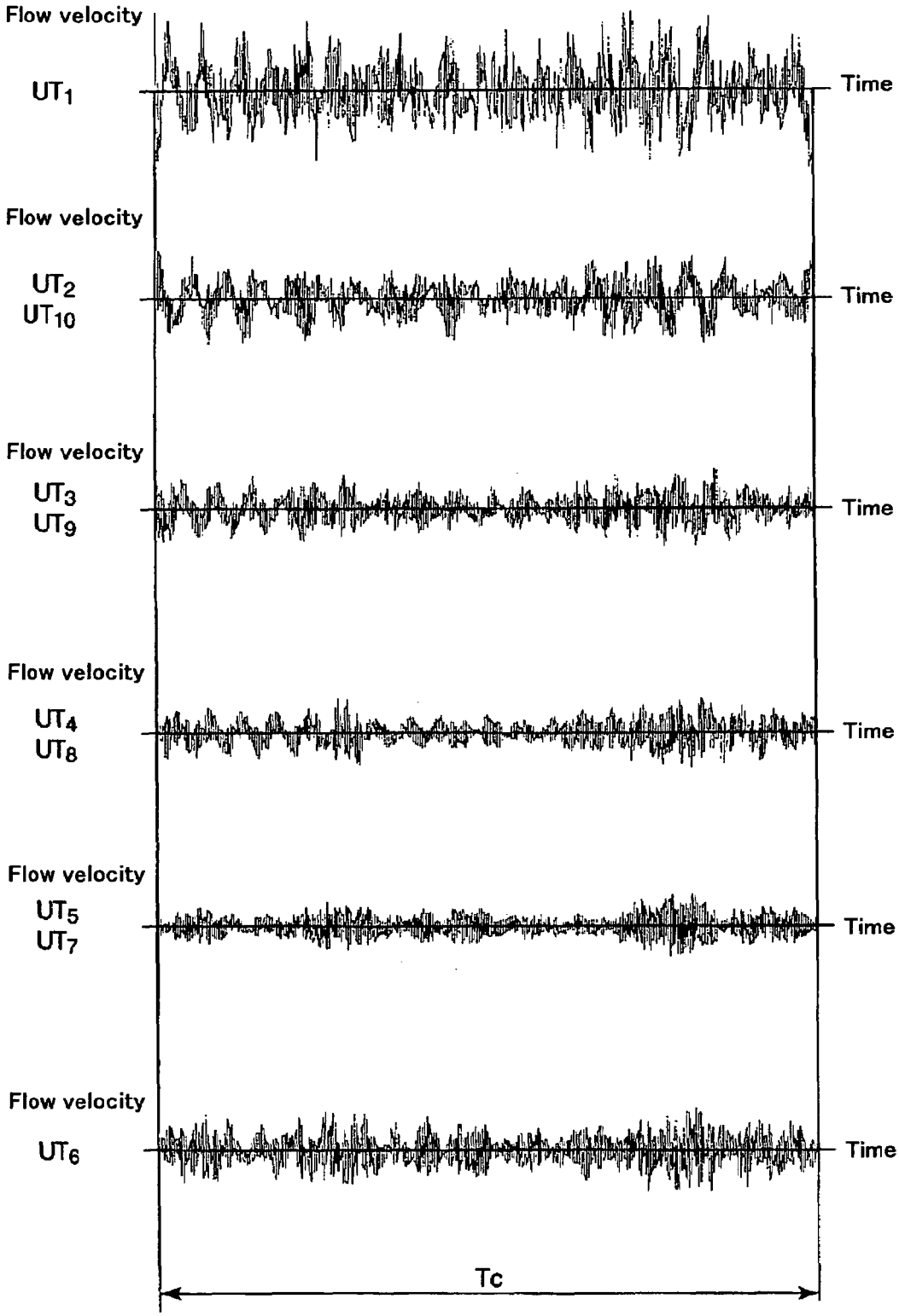
FIG. 9 illustrates vibrating flow velocities of meniscuses in response to the drive signal for measuring a frequency response characteristic of the recording head in FIG. 8.

The response characteristic R is calculated from a vibrating flow velocity UT within a nozzle responsive to a test drive signal VT. Specifically, test drive signals $VT_1$-$VT_{10}$ are applied to the respective electrodes 12*a*-12*j*. Drive signal $VT_1$ is a waveform of a noise, as seen in FIG. 8, of a low voltage having a period Tc, and drive signals $VT_2$-$VT_{10}$ are assumed to be at zero volt. Tc is preferably to be set sufficiently longer than an operation time of an ink ejection process. Furthermore, a drive pattern of every 10 channels is applied among a number of pressure chambers by applying to electrode 12*k* the same drive signal $VT_1$ as one to electrode 12*a*. Letting flow velocities of the respective meniscuses produced in nozzles 10*a*-10*j* when the recording head is driven using the above-mentioned drive pattern be $UT_1$-$UT_{10}$, vibrating flow velocities having a period of Tc, as shown in FIG. 9, are produced. The term a "channel" used herein indicates a chamber forming an electrode that communicates with one nozzle. It is used to describe a calculation of the hypothetical meniscus vibration. This vibrating flow velocity can be observed by irradiating a meniscus within a nozzle of the ink jet recording head with a laser beam for measuring, using a laser Doppler vibrometer available in the market, for example, Model LV-1710 of Ono Sokki Co., Ltd.

Subsequently, a voltage spectrum FVT and flow velocity spectrum FUT are transformed by operating Fourier-transformation of the test drive signal VT and vibrating flow velocity UT using the following formulas (1) and (2).

$$FVT_{i,k} = \frac{1}{\sqrt{m}} \cdot \sum_{j=1}^{m} VT_{i,j} \cdot e^{2\pi I(j-1)(k-1)/m} \quad (1)$$

$$FUT_{i,k} = \frac{1}{\sqrt{m}} \cdot \sum_{j=1}^{m} UT_{i,j} \cdot e^{2\pi I(j-1)(k-1)/m} \quad (2)$$

In the above formulas, "m" denotes the number of time-series flow velocity data observed by the laser Doppler vibrometer. Letting a sampling time for flow velocity data observed by a laser Doppler vibrometer be "dt," "m" is given as a value of Tc/dt. Subscript "i" is an integer denoting a channel number from 1 to 10 and corresponds to the respective electrode of 12*a*-12*j* or nozzle of 10*a*-10*j*. Subscript "j" is an integer from 1 to m denoting "j"th data from the leading in the time-series data array. "J"th data indicates data of "time j×dt." Subscript "k" is an integer from 1 to k denoting "k"th data from the leading in a sequential frequency data array, and "k"th data indicates data of a frequency "(k−1)/Tc." "I" is presented in imaginary unit. Manner of usage of the above subscripts will be applied in subsequent descriptions. $VT_1$, $UT_1$ are time-series data at a time interval of dt having a length of m, and $FVT_1$, $FUT_1$ are sequential frequency data at a frequency interval of 1/(m dt).

Response characteristic R can be obtained from FVT and FUT in the following formula (3):

$$R_{i,k}=FUT_{i,k}/FVT_{1,k} \quad (3)$$

Figure 10:
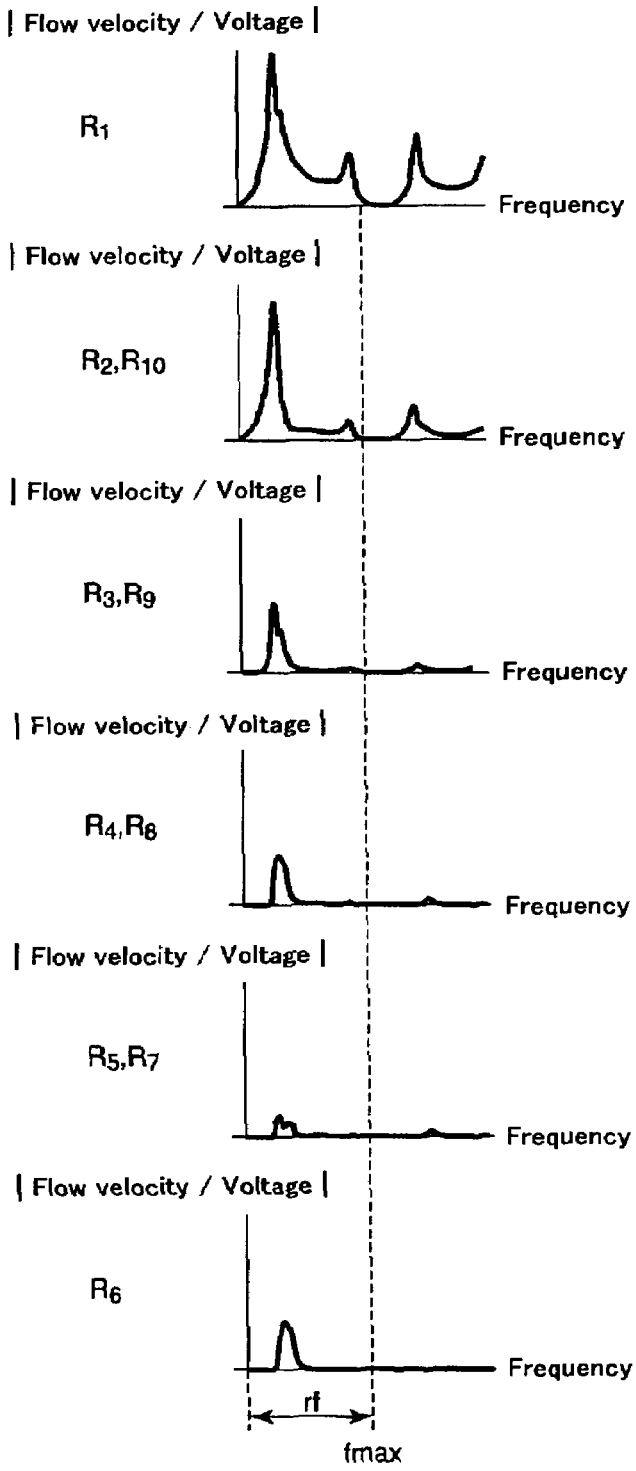
FIG. 10 illustrates a response characteristic presented in absolute values in the recording head according to the embodiment.
Figure 11:
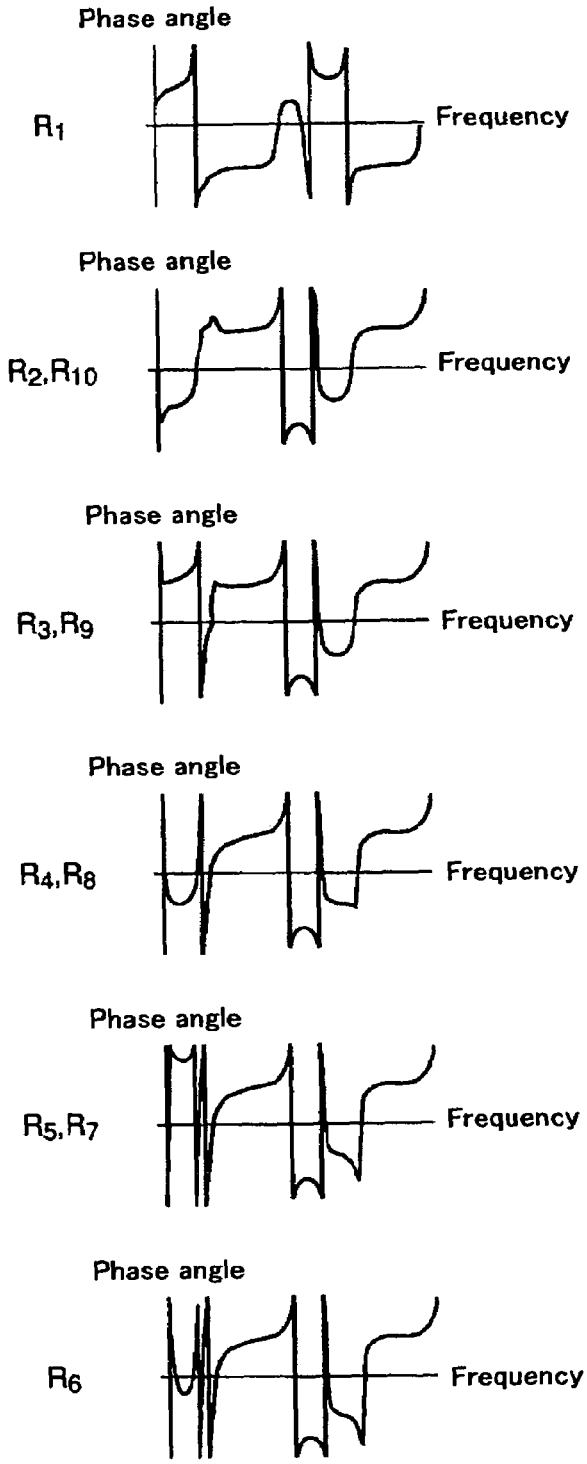
FIG. 11 illustrates a response characteristic presented in phase angles in the recording head according to the embodiment.

$R_{i,k}$ expresses in form of a complex number a variation of amplitude and phase of flow velocity $U_i$ of a meniscus within a nozzle at frequency (k−1)/Tc in response to drive signal $VT_1$. If response characteristic of each channel is represented by Ri, absolute values and phase angles in $R_1$-$R_{10}$ are shown in FIGS. 10 and 11, respectively. "f max" in FIG. 10 indicates an upper limit frequency in the frequency domain where a meniscus in nozzle 10 are responsive to the drive signal continuously from a low frequency part.

The above description has been made for the case where the test drive signal VT used a noise waveform. However, response characteristic R can also be obtained by using sine waves or cosine waves at variable frequencies as the test drive signal and measuring amplitude and phase in vibrating flow velocity of a meniscus in each frequency.

Next, a process of determining the drive signal from a hypothetical meniscus vibration using the response characteristic R obtained in the above will be described.

Figure 12:
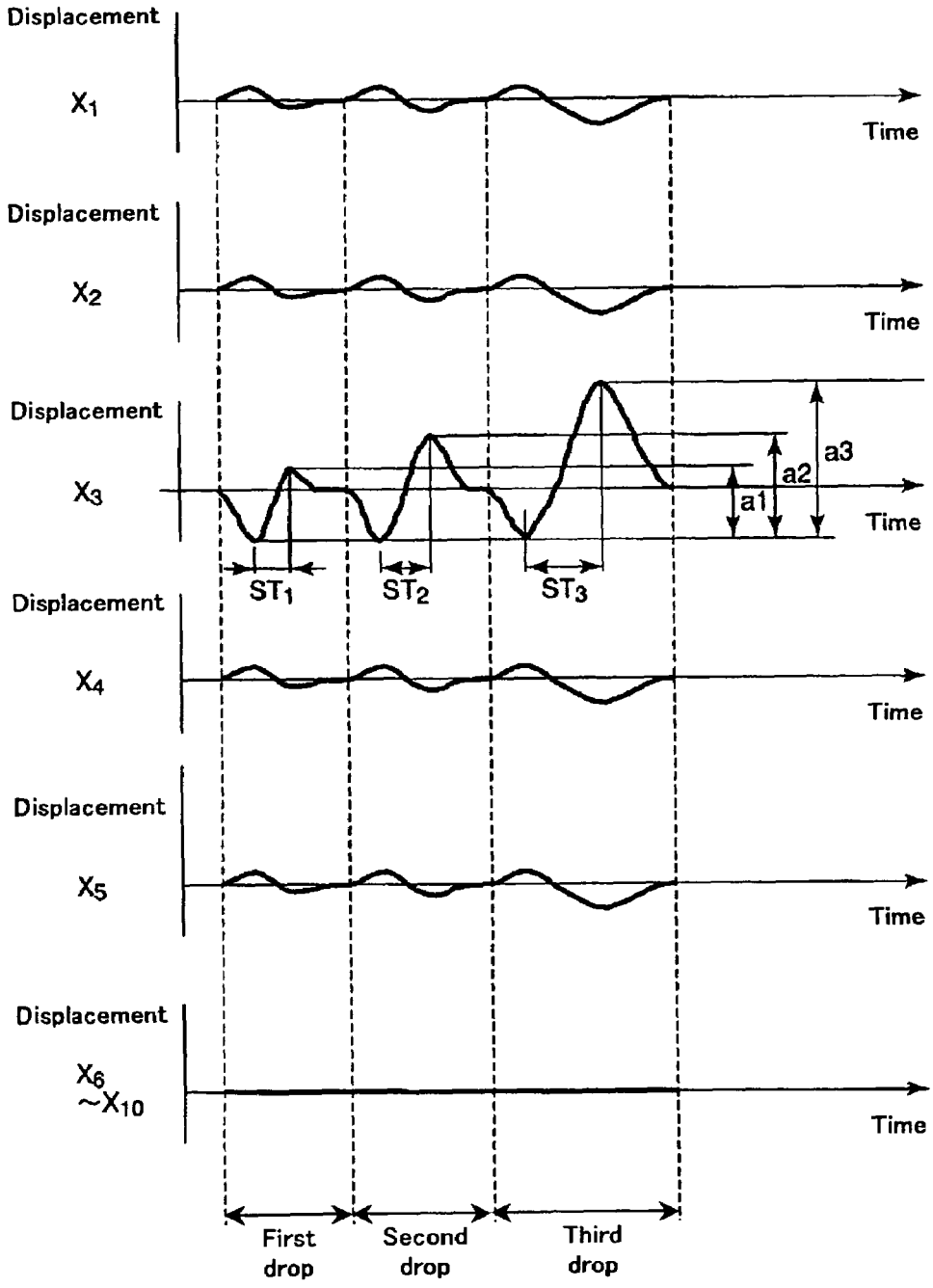
FIG. 12 illustrates hypothetical meniscus displacements in the embodiment.

FIG. 12 illustrates a displacement X of hypothetical meniscus vibration. For example, in the case that the first through third drops are ejected from pressure chamber 9*c* but none of ink from pressure chamber 9*h*, hypothetical meniscus displacements in nozzles 10*a*-10*j* are to be $X_1$-$X_{10}$, respectively, as shown. A peak value in the positive domain in each of the hypothetical meniscus displacements corresponds to a volume of an ink droplet ejected.

Now, a hypothetical meniscus flow velocity U relative to a hypothetical meniscus displacement X will be obtained, using formula (4) shown below. For convenience of calculation using formula (4) below, it is assumed that the end point of hypothetical meniscus in terms of displacement X is continuous to the start point, differential values from the starting point to the end are continuous, and the end point and the end in the result of the differential calculation are continuous as well.

$$U_i=d/dt\cdot X_i \quad (4)$$

Figure 13:
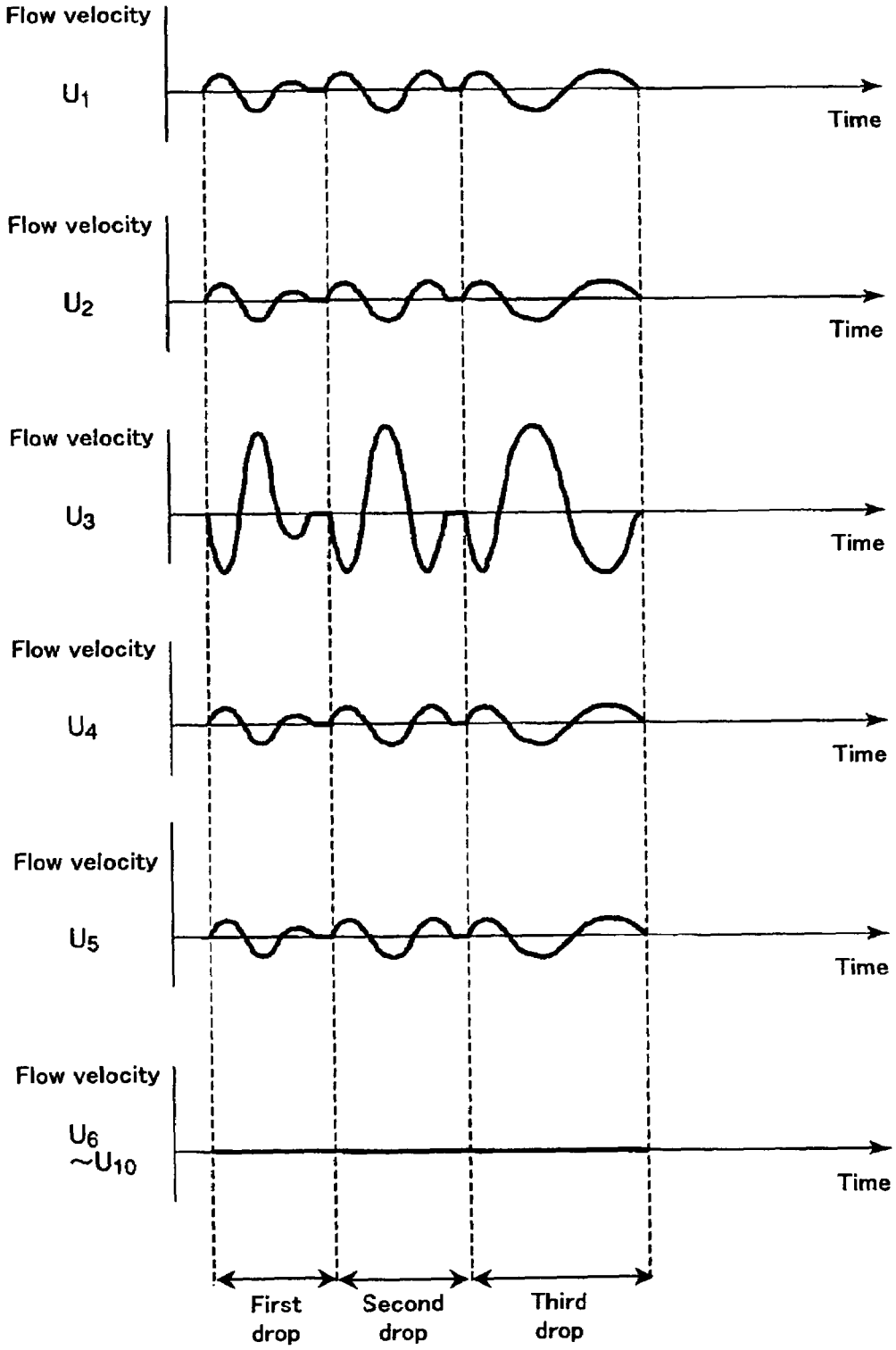
FIG. 13 illustrates flow velocities of a hypothetical meniscus in the embodiment.

FIG. 13 depicts hypothetical meniscus flow velocities $U_1$-$U_{10}$ obtained using the above formula (4). The hypothetical meniscus flow velocity is a time-series data substantially continuous from the starting point to the end, and the starting point and end point are substantially continuous as well. The hypothetical meniscus flow velocity may be defined at the beginning instead of calculating the value from a hypothetical meniscus displacement.

Next, flow velocity spectrum FU of hypothetical meniscus flow velocity U will be obtained by computing the Fourier transform of hypothetical meniscus flow velocity U using formula (5) shown below.

$$FU_{i,k} = \frac{1}{\sqrt{m}} \cdot \sum_{j=1}^{m} U_{i,j} \cdot e^{2\pi I(j-1)(k-1)/m} \quad (5)$$

Figure 14:
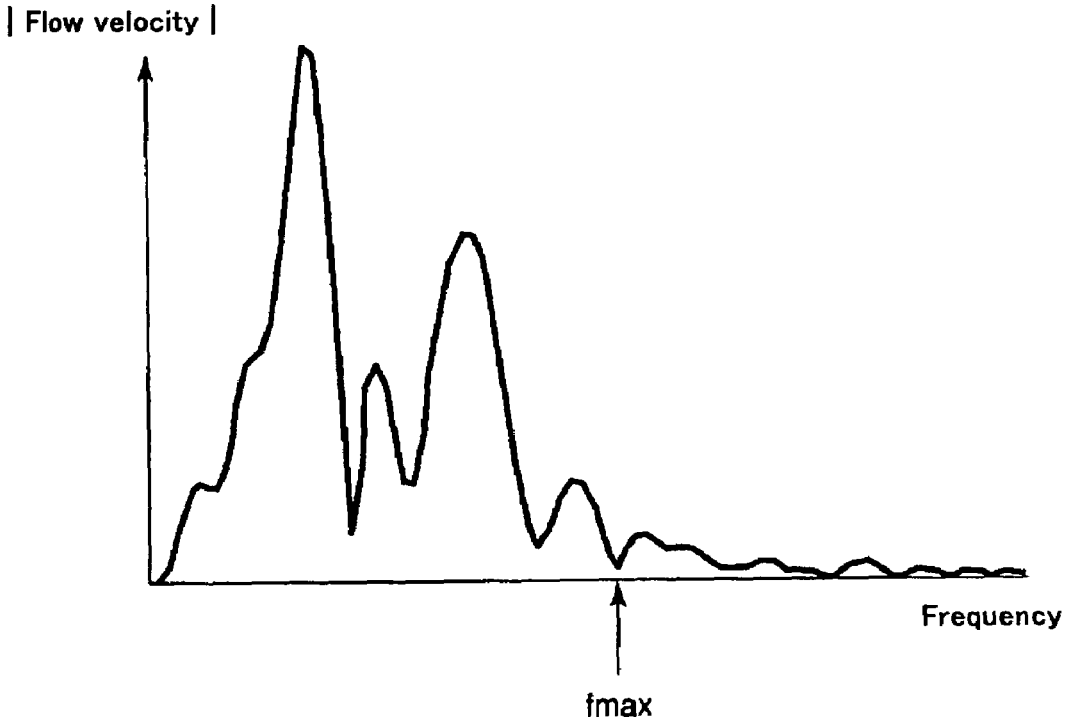
FIG. 14 illustrates a frequency response characteristic of a hypothetical meniscus in the embodiment.

In the above formula, $U_i$ represents time-series data at time interval dt and length m, and $U_{i,j}$ represents "i"th data from the head data of $U_i$. Flow velocity spectrum $FU_{i,k}$ represents amplitude and phase of the flow velocity in the hypothetical meniscus flow velocity $U_i$ at a frequency (k−1)/Tc in form of a complex number. FIG. 14 depicts $FU_3$ in an absolute value in flow velocity spectrum FU values thus obtained. It is preferable that most part of the frequency component in flow velocity spectrum FU is contained in a range lower than a frequency f max abovementioned as shown in FIG. 14.

Next, voltage spectrum FVA of the drive signal will be obtained from response characteristic R of the ink jet recording head and flow velocity spectrum FU of the hypothetical meniscus vibration. If response characteristic matrix [R] is given by formula (6) shown below, voltage vector $\{FVA\}_k$ is given by formula (7) below, and flow velocity vector $VA_k$ is given by formula (8) below, a voltage vector $FVA_k$ at a frequency (k−1)/Tc can be obtained formula (9) shown below.

$$[R]_k = \begin{bmatrix} R_{1,k} & R_{10,k} & \dots & \dots & R_{2,k} \\ R_{2,k} & R_{1,k} & \dots & \dots & R_{3,k} \\ \vdots & R_{2,k} & \dots & \dots & \vdots \\ \vdots & \vdots & & & R_{10,k} \\ R_{10,k} & R_{9,k} & \dots & R_{2,k} & R_{1,k} \end{bmatrix} \quad (6)$$

$$\{FVA\}_k = \begin{bmatrix} FVA_{1,k} \\ FVA_{2,k} \\ \vdots \\ FVA_{10,k} \end{bmatrix} \quad (7)$$

$$\{FU\}_k = \begin{bmatrix} FU_{1,k} \\ FU_{2,k} \\ \vdots \\ FU_{10,k} \end{bmatrix} \quad (8)$$

$$\{FVA\}_k = [R]_k^{-1} \cdot \{FUA\}_k \quad (9)$$

Voltage spectrum $FVA_{i,k}$ obtained in formulas (7) and (9) represents in form of a complex number a voltage amplitude and phase of drive signal $VA_i$ at a frequency (k−1)/Tc that produces hypothetical meniscus flow velocity $U_i$. The element in row "a" at column "b" of $[R]_k$ obtained in formula (6) represents a variation of amplitude and phase of vibrating flow velocity of a meniscus, in form of a complex number, within a nozzle provided in "a"th channel relating to a voltage vibration in "b"th channel at a frequency (k−1)/Tc. $[R]_k^{-1}$ is an inverse matrix of $[R]_k$. Computation of the inverse matrix can be performed by using mathematical formula analysis software tool "MATHMATICA" provided by WOLFRAM RESEARCH Ltd.

Next, drive signal VA will be calculated. Drive signal VA can be obtained by computing the Fourier inverse transform of voltage spectrum FVA in the following formula (10).

$$VA_{i,j} = \mathrm{Re}\left[\frac{2}{\sqrt{m}} \cdot \sum_{k=1}^{m'} FVA_{i,k} \cdot e^{-2\pi I(k-1)(j-1)/m}\right] \quad (10)$$

Herein, Re[Z] is a function for obtaining a portion of a real number "a" in a complex number z=a+bI. $VA_{i,j}$ represents a voltage of drive signal VA at time j×dt in "i"th channel that produces hypothetical meniscus flow velocity U.

Drive signal $VA_i$ is applied to the recording head as shown in FIG. 1. That is, drive signals $VA_1$-$VA_{10}$ are applied to electrodes 12*a*-12*j*, respectively, so that hypothetical meniscus displacements $X_1$-$X_{10}$ are made to occur on meniscuses in nozzles 10*a*-10*j*.

m' is a largest integer in a value given by m'≦f max·Tc. By thus setting the upper limit frequency of the inverse Fourier transform to f max, the upper limit value in the frequency component of drive signal VA is now determined to be "f max."

Figure 15:
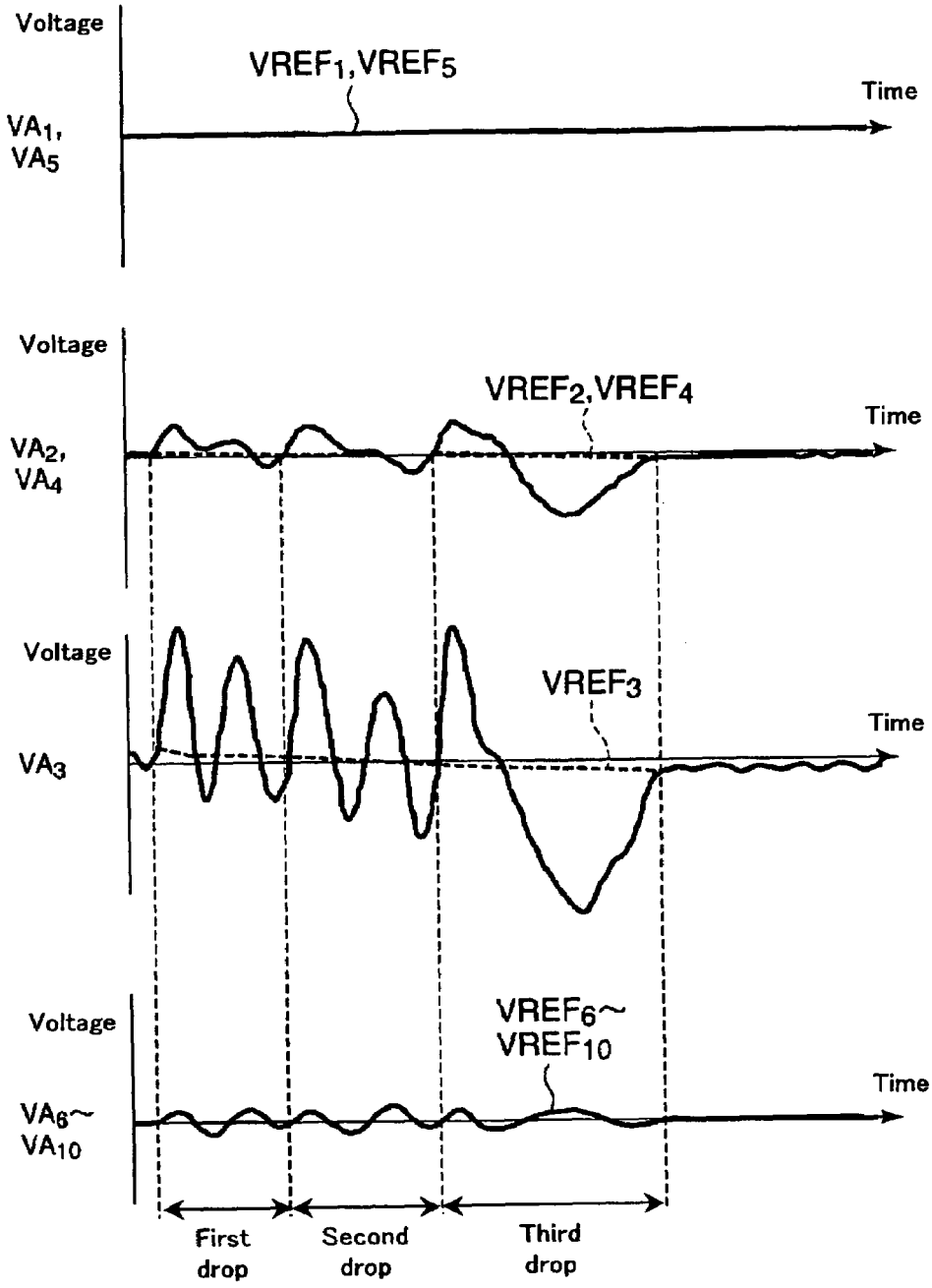
FIG. 15 illustrates waveforms of drive signals each obtained by computation using a flow velocity of a hypothetical meniscus and response characteristic of the recording head according to the embodiment.

When a waveform of the drive signal is calculated back from a hypothetical meniscus vibration using the Fourier transform, a divergence of the calculation result can be prevented by limiting the frequency range in the calculation to between zero and f max, which is the range of a frequency response of the ink jet recording head. To reproduce a hypothetical meniscus vibration at a sufficient accuracy from the drive signal having the waveform obtained by this calculation, it is desirable that "f max" cover the most part of the frequency component in flow velocity spectrum FU. "f max" varies depending on dimensions of the ink jet recording head, such as length L of the pressure chamber. Accordingly, it is desirable that dimensions of the ink jet recording head be adjusted so that "f max" contains the most of the frequency component in flow velocity spectrum FU. FIG. 15 displays drive signal VA ($VA_1$-$VA_{10}$) obtained in the manner as described above.

Figure 16:
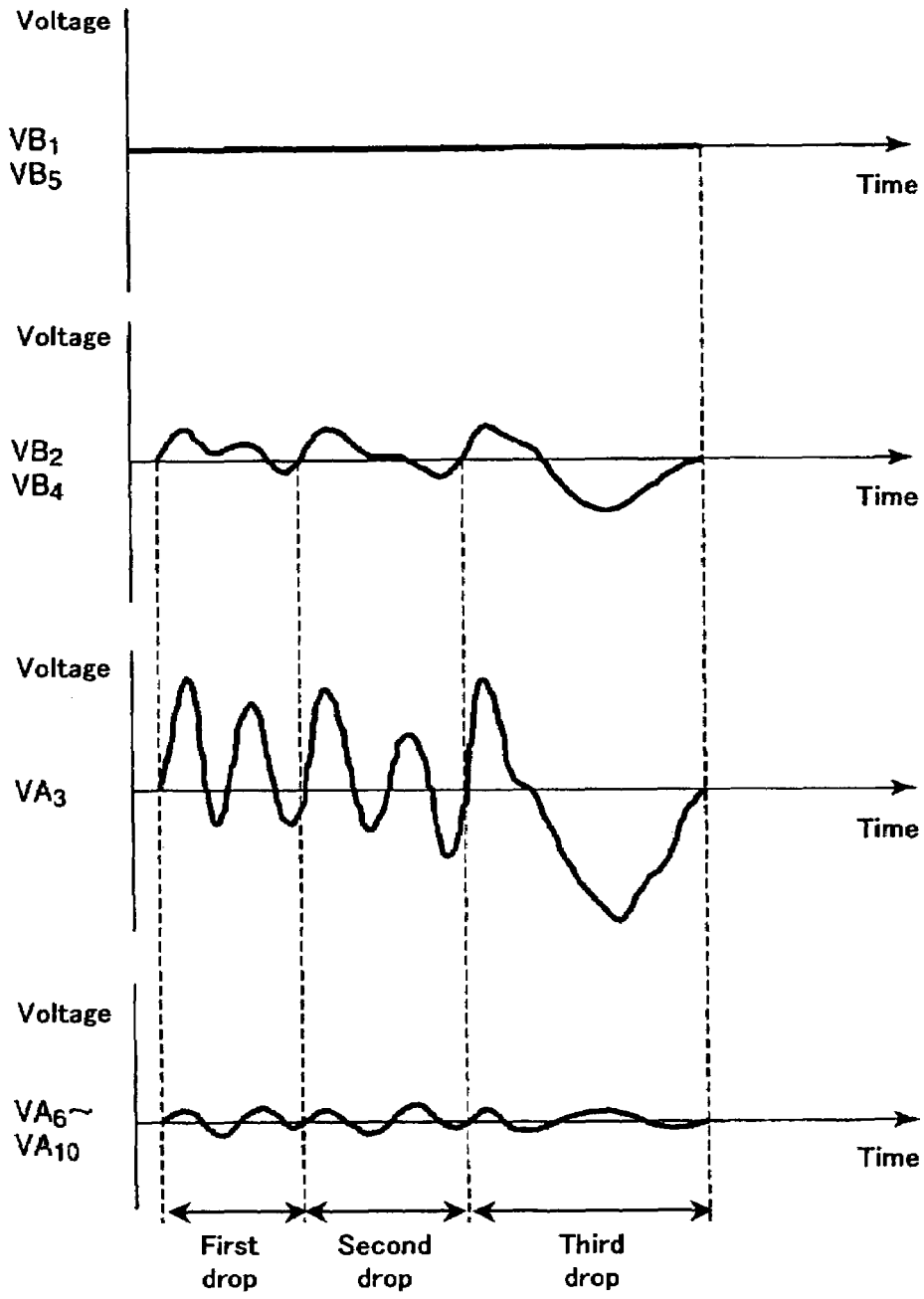
FIG. 16 illustrates waveforms of a drive signal modified from the drive signal waveforms shown in FIG. 15.

The drive signal VA thus obtained can be used, as is, as a drive signal in the ink jet recording head. Instead of using drive signal VA, as is, however, drive signal VB ($VB_1$-$VB_{10}$) shown in FIG. 16 may be produced by calculating a difference between the drive signal VA and reference voltage VREF ($VREF_1$-$VREF_{10}$) depicted in a dotted line in FIG. 15 so that the time period of the drive signal from the first droplet to the third droplet can be reduced. Thus, the drive period of the ink jet recording head can be reduced and thereby the printing speed can be improved.

Figure 17:
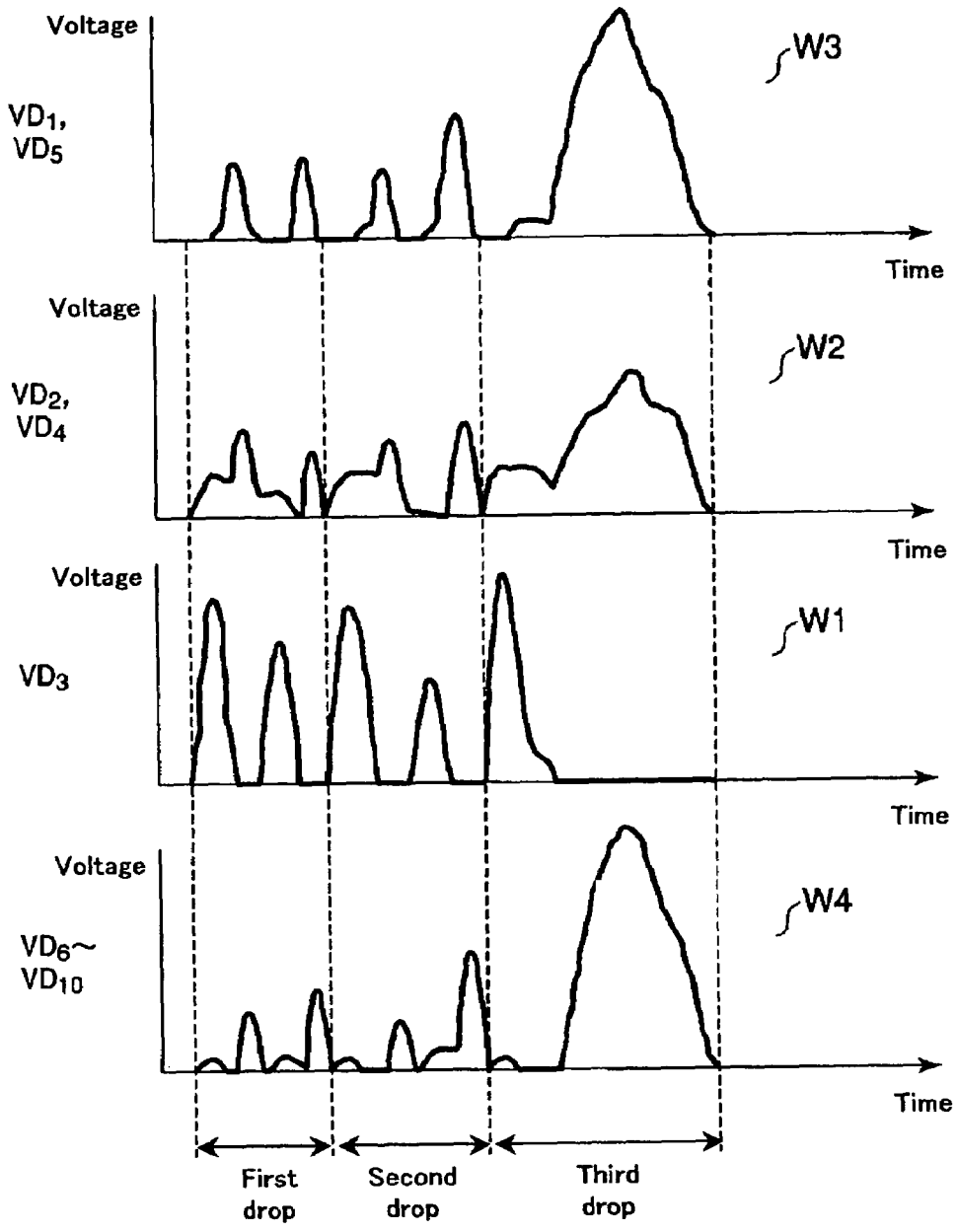
FIG. 17 illustrates waveforms of a drive signal further modified from the drive signal waveforms shown in FIG. 16.

Drive signal VB thus obtained can be used also as is, as drive signal in the ink jet recording head. However, the voltage amplitude can be reduced by using drive signal VD calculated by the following formula (11). This reduction of the voltage amplitude of the drive signal can reduce the cost of a drive circuit of the recording head and hence an inexpensive ink jet recording apparatus can be provided. FIG. 17 displays drive signals $VD_1$-$VD_{10}$.

$$VD_{i,j} = Vb_{i,j} - \mathrm{MIN}\,[VB_{1,j}, VB_{2,j}, \ldots VB_{10,j}] \quad (11)$$

Herein, MIN [$VB_{1,j}$, $VB_{2,j}$, . . . $VB_{10,j}$] is a function representing a minimum value within values of [$VB_{1,j}$, $VB_{2,j}$, . . . $VB_{10,j}$]. Drive signal $VD_3$ obtained in this calculation becomes drive signal W1, drive signal $VD_2$ or $VD_4$ becomes drive signal $W_2$, drive signal $VD_1$ or $VD_5$ becomes drive signal $W_3$, and any one of drive signal $VD_6$-$VD_{10}$ becomes drive signal $W_4$.

The above method of producing drive signals can be applied to actual production of an ink jet recording apparatus by following the procedure described below. First, a response characteristic R responsive to a drive signal of the ink jet recording head that is manufactured is to be measured, using a test drive signal such as a noise waveform or sine wave. Then, a waveform of drive signal is produced by computing formulas (4) through (10) based on the response characteristic and a predefined hypothetical meniscus vibration. Further, if needed, the waveforms of the drive signal are modified using formula (11) or others. At last, the waveforms thus obtained are stored in drive waveform memory 21 of the ink jet recording apparatus.

The hypothetical meniscus vibration will be further described in detail. Displacements $X_1$-$X_{10}$ shown in FIG. 12 represent displacements of the hypothetical meniscus vibrations within the respective nozzles 10*a*-10*j* wherein the first drop through the third drop are ejected from pressure chamber 9*c* but none is ejected from pressure chamber 9*h*. $U_1$-$U_{10}$ in FIG. 13 represent hypothetical meniscus flow velocities in the respective nozzles 10*a*-10*j*.

This embodiment illustrates by examples displacement $X_3$ of the hypothetical meniscus vibration in nozzle 10*c* from which ink is ejected, as seen in FIG. 12. Letting ejection times on ejections of the first drop, second drop, and third drop be $st_1$, $st_2$, $st_3$, respectively, and movements of hypothetical meniscus displacements be a1, a2, and a3, respectively, the relationship among them is defined as follows:

$$a1/st_1 \approx a2/st_2 \approx a3/st_3$$

By defining the hypothetical meniscus vibration so that a ratio between the ink ejection time and amount of the hypothetical meniscus displacement is to be constant, ink droplets having different volumes can be ejected at nearly the same velocities.

The displacements of the hypothetical meniscus vibrations in nozzles 10*b* and 10*d* adjacent to nozzle 10*c*, $X_1$, $X_2$, $X_4$, and X5, and nozzles 10*a* and 10*e* adjacent to nozzles 10*b* and 10*d* are set to −⅓ of hypothetical meniscus vibration displacement $X_3$ in nozzle 10*c*. By setting the hypothetical meniscus vibrations in this way, meniscus vibrations produced in nozzles 10*b* and 10*d* associated with ink ejection from nozzle 10*c* are made deconcentrated towards nozzles 10*a* and 10*e* and thereby the amplitudes of meniscus vibrations in nozzles 10*b* and 10*d* are suppressed. This effects to suppress protrusions of the meniscuses in nozzles 10*b* and 10*d* and reduce variation in velocity and volume among ink droplets ejected from nozzles 10*b* and 10*d*.

Furthermore, the respective amplitudes of hypothetical meniscus flow velocities $U_6$-$U_{10}$ in non-ink ejecting nozzle 10*h*, nozzles 10*g* and 10*i* adjacent to nozzle 10*h*, and nozzles 10*f* and 10*j* adjacent to nozzles 10*g* and 10*i* are set to zero. This defines a condition by the hypothetical meniscus vibration in that, even if a vibrating flow velocity occurs in nozzle 10*e*, a subsequent occurrence of vibrating flow velocity in nozzle 10*f* is prevented. In other words, such condition is defined by the hypothetical meniscus vibration that, even if a pressure vibration is produced in pressure chamber 9*e*, a pressure vibration in pressure chamber 9*f* is not developed. This further means that such hypothetical meniscus vibration defines the condition so that cross talk between pressure chambers 9*e* and 9*f* becomes zero.

When, first defining hypothetical meniscus vibrations in nozzles 10*a*-10*e* in which meniscus vibrations are made to occur and nozzles 10*f*-10*j* in which meniscus vibrations are made not to occur, and relative drive signals are calculated back from these hypothetical meniscus vibrations and the response characteristic of the ink jet recording head, drive signal "W4" shown in FIG. 17 can be obtained as signals for driving the pressure chambers relative to nozzles 10*f*-10*j* in which meniscus vibrations are made not to occur. Since this drive signal W4 blocks off pressure fluctuation within pressure chamber 9*e* associated with ink ejection from nozzle 10*c* transmitting to pressure chamber 9*f* through subsequent deflection of actuator 14*f*, this drive signal would be regarded as one that substantially zeroes the deflection of actuator 14*f*.

Figure 18:
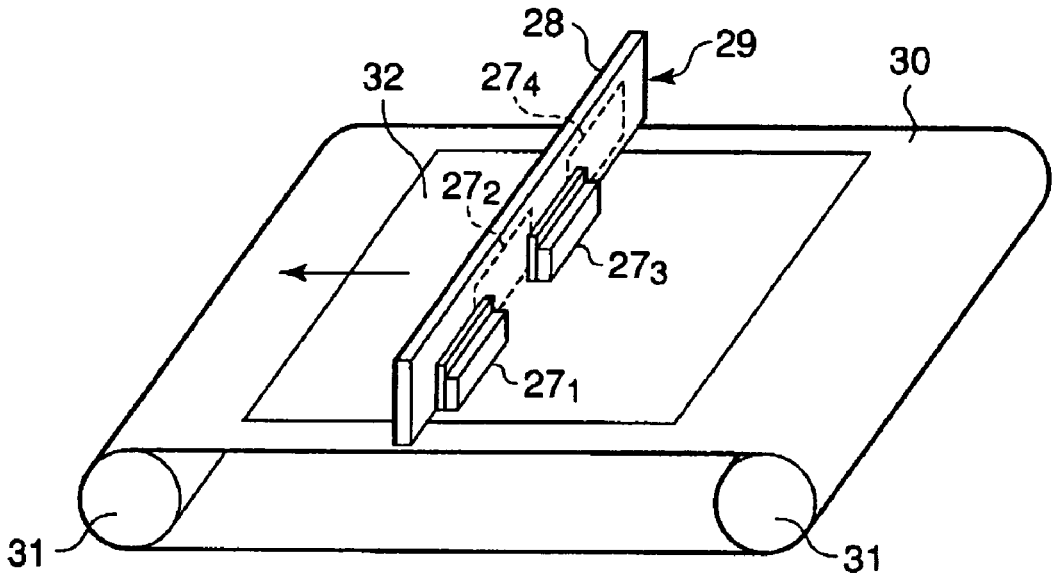
FIG. 18 is a perspective view illustrating appearance of principal parts of an ink jet recording apparatus according to the embodiment.

FIG. 18 is a perspective view illustrating an exterior of the principle part of the ink jet recording apparatus to whose recording head the above-mentioned control method is implemented. This ink jet recording apparatus incorporates a line head 29 in which, for example, four recording heads $\mathbf{27}_1$, $\mathbf{27}_2$, $\mathbf{27}_3$, and $\mathbf{27}_4$ are disposed on the both sides of substrate 28 in staggered fashion.

Line head 29 is installed with a predetermined gap from a medium conveying belt 30. Medium conveying belt 30, which is driven by a belt drive roller 31 in an arrow direction, conveys a recording medium 32 such as a paper in contact with the surface of the belt. Printing is made such that, when recording medium 32 passes under line head 29, ink droplets are caused to be ejected from the respective recording head $\mathbf{27}_1$-$\mathbf{27}_4$ downwards and deposited on recording medium 32. To attract and keep in contact recording medium 32 to medium conveying belt 30, a known method, such as one that causes to suck the recording medium using static electricity or air flow, or one that presses ends of the recording medium can be used.

Recording by the respective recording head is made in a line on the recording medium by adjusting timing of ejecting ink droplets from nozzles of the pressure chambers in the respective ink jet recording heads $\mathbf{27}_1$-$\mathbf{27}_4$ of the line head 29.

In this embodiment, amplitudes of the meniscus vibrations in the respective nozzles 10*f*-10*j* were set to zero. However, a vibration at an appropriate level can be imparted to nozzles 10*f*-10*j*, if such a level is a degree insufficient to eject an ink droplet. In this case, each of the hypothetical meniscus vibrations $X_6$-$X_{10}$ is defined with a meniscus vibration having a small amplitude, and a waveform of the drive signal can be inverse-calculated using the above-described method.

Also, in this embodiment, the drive circuit was configured such that drive signal waveform memory 21 was provided for storing waveform information relative to drive signals ACT1-ACT5 that are applied to ink-ejecting pressure chamber 9 and waveform information relative to drive signals INA that are to be applied to non-ink-ejecting pressure chamber, and these drive signals are read from drive signal waveform memory 21 and selected by drive signal selecting means 24. The structure need not be limited to such a scheme.

Figure 19:
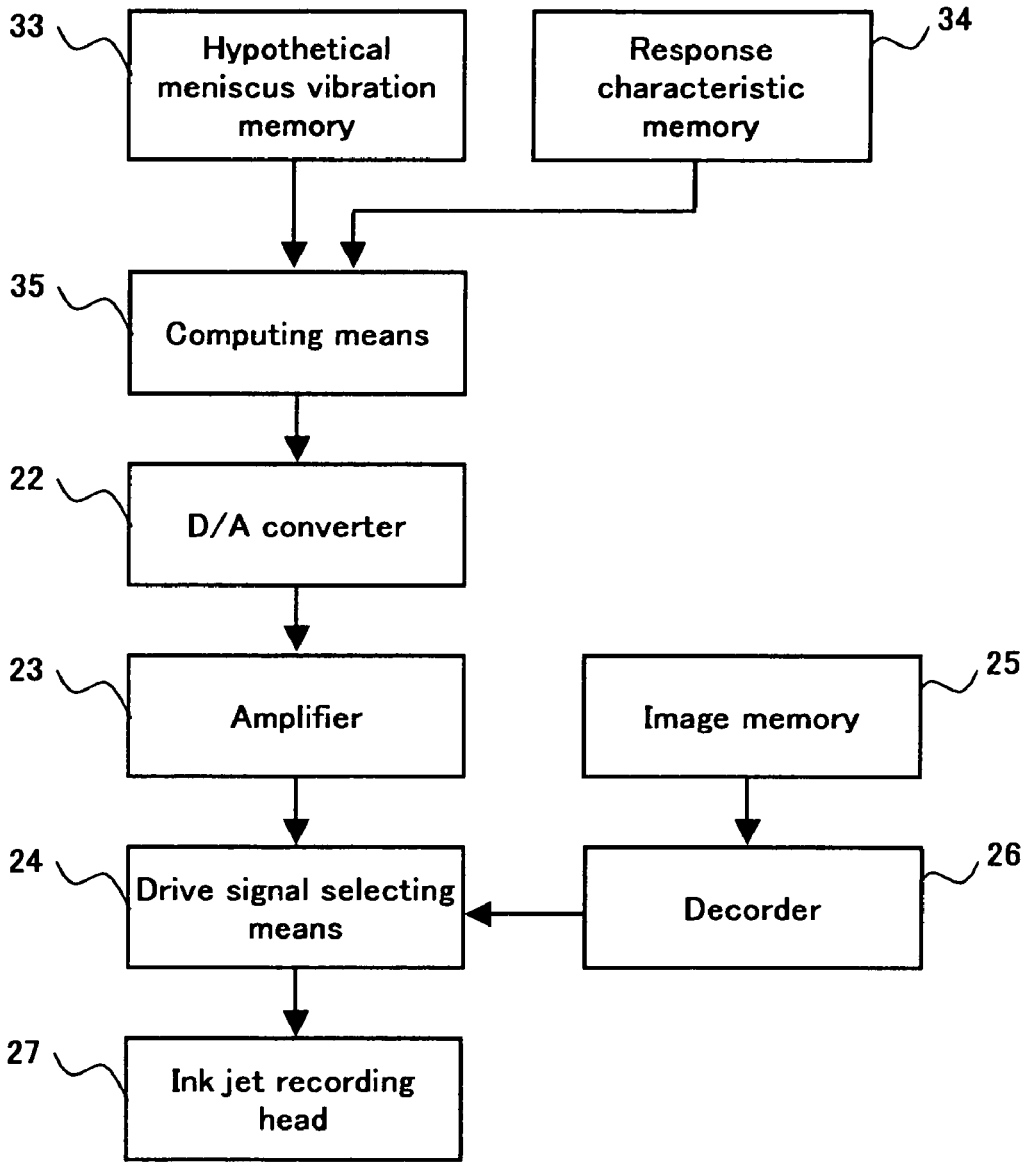
FIG. 19 is a functional block diagram of a drive circuit of an ink jet recording head according to another embodiment of the present invention.

Alternatively, for example, an ink jet recording apparatus as illustrated in FIG. 19 can be contemplated, which comprises hypothetical meniscus vibration memory 33 for storing information on hypothetical meniscus vibrations, response characteristic memory 34 for storing information on response characteristic R, and computing means 35. In this ink jet recording apparatus, control for ink ejection can be made such that computing means 35 computes a hypothetical meniscus flow velocity U from a displacement of the hypothetical meniscus vibration in hypothetical meniscus vibration memory 33, a flow velocity spectrum FU from this hypothetical meniscus flow velocity U, a voltage spectrum FVA from this flow velocity spectrum FU and response characteristic R stored in response characteristic memory 34; drive signals W1, W2, W3, and W4 are obtained by computing formulas (10) and (11), then drive signals ACT1-ACT5 and INA are obtained from the resulted drive signals; lastly, these drive signals ACT1-ACT5 and INA are selected by drive signal selecting means 24.

To simplify such computations, it is desirable that, either the frequency response of the voltage waveform VA at more than f max be cut in computing means 35, or the frequency response of the hypothetical meniscus vibration at more than f max stored in hypothetical meniscus vibration memory 33 or the response characteristic at more than f max stored in response characteristic memory 34 be cut off prior to performing the computation.

Furthermore, in this embodiment, in the case that five pressure chambers close around the pressure chamber from which ink is intended not to be ejected at the time-divisional timing when ink ejection is enabled, that is, where the first drop is to be ejected from pressure chamber 9*c* but not from pressure chamber 9*h*, drive signal W4*a* was applied at the same time to electrodes 12*f*-12*j* of the chambers 9*f*-9*j*. The method need not be restricted to the above scheme. Drive signal W4*a* needs to be applied only at least electrode 12*f* of pressure chamber 9*f* that is disposed at the outmost position. Even in this case, a resisting force against a movement of deflection of actuator 14*f* by pressure generated in pressure chamber 9*e* is produced by virtue of the potential difference between drive signals W3*a* and W4*a* so that actuator 14*f* is substantially unaffected.

In this embodiment, operations in the five time-divisional drive method have been described. However, the drive method need not be restricted to this. The procedures described above can be easily applied in three time-divisional drive method as well, and it is apparent that cross talk between the pressure chambers that likely occurs in three time-divisional drive method can also substantially be zeroed. This method is also applicable to seven or more odd-numbered time divisional drive method as well.

Numerous modifications and variations of the present invention are possible in light of the above teachings. It is therefore to be understood that, within the scope of the appended claims, the present invention can be practiced in a manner other than as specifically described therein.

What is claimed is:

1. An ink jet recording apparatus comprising:

an ink jet recording head having a plurality of nozzles from each of which ink is ejected, a plurality of pressure chambers communicating with the respective nozzles, ink supplying means for supplying ink to the respective pressure chambers, a plurality of electrodes provided relative to the respective pressure chambers for causing ink to be ejected, and piezoelectric actuators that form side walls isolating the pressure chambers and are caused to deflect so as to vary a volume of the pressure chamber from which ink is to be ejected according to drive signals applied between a first electrode associated with the pressure chamber from which ink is to be ejected and two electrodes adjacent to the first electrode; and a drive signal generator, for driving the pressure chambers so as to concurrently eject ink droplets from every N pressure chambers, the drive signal generator configured to supply a deflection-preventing signal to an outmost actuator among (N+l) actuators closely disposed with the center of a pressure chamber caused to have ink ejected, to at least one of two electrodes sandwiching the outmost actuator, the deflection-preventing signal producing an electric potential difference between the two electrodes, where N=2M+1 and M>1, wherein the electric potential difference produced by the deflection-prevention signal provides the outmost actuator with a force that counteracts a force that tends to make the outmost actuator deflect due to exertion of ink pressure by the ink ejecting pressure chamber.

2. The ink jet recording apparatus according to claim 1, wherein said deflection-preventing signal is supplied to at least an electrode relative to the outmost pressure chamber among the N pressure chambers closely disposed with the center on the pressure chamber from which ink is caused not to be ejected at the timing when ink ejection is enabled.

3. The ink jet recording apparatus according to claim 1, wherein said deflection-preventing signal is simultaneously applied to the electrodes relative to the N pressure chambers close around the pressure chamber from which ink is caused not to be ejected.

4. The ink jet recording apparatus according to claim 1, wherein said deflection-preventing signal is generated based on a waveform computed from a predefined hypothetical meniscus flow velocities and a response characteristic of meniscus flow velocities obtained according to measurements of meniscus vibrations within nozzles responsive to a voltage signal.

5. The ink jet recording apparatus according to claim 4, wherein said computation by the response characteristic of meniscus flow velocities and the hypothetical meniscus flow velocities is calculated by computing a voltage vector {FVA} by $[R]^{-1}-\{FU\}$ and Fourier inverse transforming of the voltage vector {FVA}, where a vector of hypothetical meniscus flow velocities in a plurality of nozzles is {U}, vector of flow velocity spectrums as the result of the Fourier transform of the vector of hypothetical meniscus flow velocities {U} is {FU}, and a matrix of a response characteristic of the meniscus flow velocities in the respective plural nozzles responsive to a drive signal is {R}.

6. The ink jet recording apparatus according to claim 5, wherein in computing by the response characteristic of meniscus flow velocities and the hypothetical meniscus flow velocities, a frequency component at or more than a predetermined frequency is cut off.

* * * * *